US012808613B2

(12) United States Patent
Wang et al.

(10) Patent No.: US 12,808,613 B2
(45) Date of Patent: Nov. 24, 2026

(54) HEAT EXCHANGER

(71) Applicant: ZHEJIANG SANHUA INTELLIGENT CONTROLS CO., LTD., Shaoxing City (CN)

(72) Inventors: Lizhi Wang, Shaoxing City (CN); Haobo Jiang, Shaoxing City (CN); Yueqi Jin, Shaoxing City (CN)

(73) Assignee: ZHEJIANG SANHUA INTELLIGENT CONTROLS CO., LTD., Shaoxing City (CN)

( * ) Notice: Subject to any disclaimer, the term of this patent is extended or adjusted under 35 U.S.C. 154(b) by 114 days.

(21) Appl. No.: 18/796,290

(22) Filed: Aug. 6, 2024

(65) Prior Publication Data

US 2024/0393066 A1 Nov. 28, 2024

Related U.S. Application Data

(63) Continuation of application No. PCT/CN2023/094469, filed on May 16, 2023.

(30) Foreign Application Priority Data

May 31, 2022 (CN) ..... 202210606033.5

(51) Int. Cl.
*F28F 9/02* (2006.01)
*F28D 7/16* (2006.01)

(52) U.S. Cl.
CPC ..... *F28F 9/0243* (2013.01); *F28D 7/16* (2013.01)

(58) Field of Classification Search
CPC ..... F28F 9/0243; F28F 9/0275; F28F 9/02; F28F 9/0278; F28F 9/028; F28F 9/0212;
(Continued)

(56) References Cited

U.S. PATENT DOCUMENTS 10,048,025 B2 * 8/2018 Wang ..... F25B 39/028
2011/0203308 A1 8/2011 Chiang et al.
(Continued)

FOREIGN PATENT DOCUMENTS

CN 103644688 A 3/2014
CN 104019582 A 9/2014
(Continued)

*Primary Examiner* — Jon T. Schermerhorn, Jr.
(74) *Attorney, Agent, or Firm* — Cheng-Ju Chiang

(57) ABSTRACT

A heat exchanger includes a first collecting pipe and a distributor. The first collecting pipe defines a first collecting cavity in which the distributor is at least partially located. The distributor includes a first distribution pipe, a second distribution pipe and a connecting component. The connecting component is located at least partially between the first distribution pipe and the second distribution pipe. The first distribution pipe defines a number of first distribution holes. The second distribution pipe defines a number of second distribution holes. The first distribution holes and the second distribution holes are in communication with the first collecting cavity, respectively. The first distribution pipe and the second distribution pipe are connected face to face through the connecting component, thereby increasing a contact area at a connection between the first distribution pipe and the second distribution pipe, and ensuring strong connection reliability.

18 Claims, 11 Drawing Sheets

(58) Field of Classification Search
CPC ..... F28F 9/027; F28D 7/16; F28D 1/0443; F25B 39/028
USPC ..... 165/175
See application file for complete search history.

(56) References Cited

U.S. PATENT DOCUMENTS

| | | | | |
|---|---|---|---|---|
| 2015/0362263 | A1 | 12/2015 | Wang et al. | |
| 2021/0285733 | A1 * | 9/2021 | Qi | F28D 1/05366 |

FOREIGN PATENT DOCUMENTS

| | | | | |
|---|---|---|---|---|
| CN | 103644688 | B | 4/2016 | |
| CN | 106123409 | A | 11/2016 | |
| CN | 208187187 | U | 12/2018 | |
| CN | 215176222 | U | 12/2021 | |
| CN | 114636261 | A | 6/2022 | |
| WO | WO-2021258980 | A1 * | 12/2021 | F28F 9/007 |
| WO | 2023/231763 | A1 | 12/2023 | |

* cited by examiner

HEAT EXCHANGER

CROSS-REFERENCE TO RELATED APPLICATION

The present disclosure is a bypass continuation of International (PCT) Patent Application No. PCT/CN2023/094469, filed on May 16, 2023, which further claims priority of a Chinese Patent Application No. 202210606033.5, filed on May 31, 2022 and titled "HEAT EXCHANGER", the entire content of which is incorporated herein by reference.

TECHNICAL FIELD

The present disclosure relates to the technical field of heat exchange, and in particular to a heat exchanger.

BACKGROUND

Heat exchangers, also called heat exchange device, are widely used in heat exchange systems. The heat exchanger can be used for heat exchange between a heat exchange medium and the external air, or between two heat exchange media. The heat exchanger in the related art uses a distribution device to evenly distribute a fluid in a collecting pipe. Specifically, the distribution device has two side-by-side distribution pipes. The two distribution pipes are located in a cavity of the collecting pipe. The distribution pipe defines a distribution hole for distributing the fluid. Two ends of the two distribution pipes are directly connected through circumferential walls of the distribution pipes. The two distribution pipes are directly connected through the pipe walls and are connected in a line, a connection area thereof is small, there is a possibility of virtual welding, and the connection is unreliable. Therefore, inventors believe that there is still a need to improve the technical solution to increase the reliability of the connection between the two distribution pipes.

SUMMARY

In order to solve the deficiencies of related technologies, the present disclosure adopts the following technical solution: a heat exchanger, including: a first collecting pipe and a distributor, the first collecting pipe defining a first collecting cavity, the distributor being at least partially located in the first collecting cavity;

wherein the distributor includes a first distribution pipe, a second distribution pipe and a connecting component; the first distribution pipe and the second distribution pipe are disposed side by side and spaced apart from each other; the connecting component is located at least partially between the first distribution pipe and the second distribution pipe;

the first distribution pipe defines a plurality of first distribution holes; the second distribution pipe defines a plurality of second distribution holes; the first distribution holes and the second distribution holes are in communication with the first collecting cavity, respectively;

the first distribution pipe has a first mating surface; the second distribution pipe has a second mating surface; the connecting component has a third mating surface and a fourth mating surface; the first mating surface is mated with the third mating surface; the second mating surface is mated with the fourth mating surface;

the first distribution pipe defines a first distribution chamber; the second distribution pipe has a second distribution chamber; the connecting component defines a connection channel; the connection channel is located between the first mating surface and the second mating surface, and communicates with the first distribution chamber and the second distribution chamber.

The present disclosure uses the connecting component to connect the first distribution pipe and the second distribution pipe, and communicate with the first distribution chamber and the second distribution chamber. The surface-to-surface connection between the connecting component and the distribution pipes increases the connection area between the first distribution pipe and the second distribution pipe, thereby increasing the connection reliability between the first distribution pipe and the second distribution pipe.

DETAILED DESCRIPTION

Figure 1:
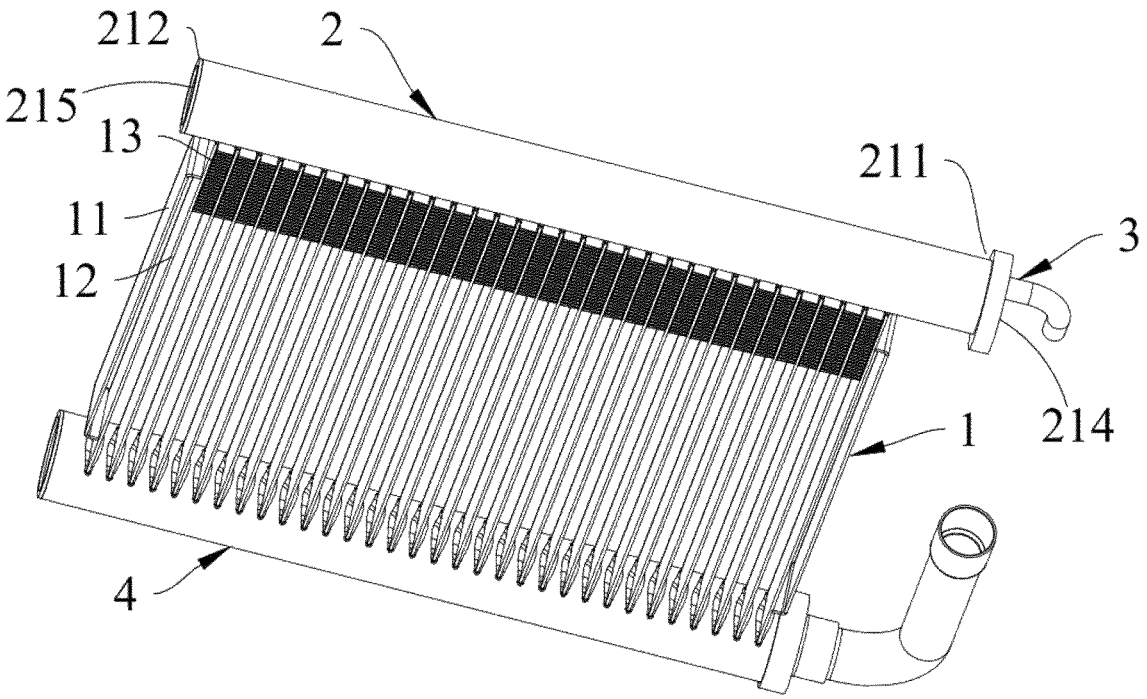
FIG. 1 is a schematic perspective structural view of a heat exchanger in some embodiments of the present disclosure.

Reference will now be made in detail to the exemplary embodiments, examples of which are illustrated in accompanying drawings. When the following description refers to the accompanying drawings, the same numerals in different drawings refer to the same or similar elements unless otherwise indicated. The embodiments described in the following exemplary implementations do not represent all implementations consistent with the present disclosure. Rather, they are merely examples of apparatuses and methods consistent with aspects of the present disclosure as recited in the appended claims.

The terms used in the present disclosure are only for the purpose of describing specific embodiments, and are not intended to limit the protection scope of the present disclosure. As used in the specification and claims of the present disclosure, the singular forms "a", "the" or "said" are intended to include the plural forms as well, unless the context clearly dictates otherwise.

It should be understood that "first", "second" and similar words used in the specification and claims of the present disclosure do not indicate any order, quantity or importance, but are only used to distinguish different components. Similarly, similar words such as "a" or "an" do not mean a quantity limit, but mean that there is at least one. Term "multiple" or "a plurality of" means two or more quantities, unless otherwise stated.

The exemplary embodiments of the present disclosure will be described in detail below with reference to the drawings. In the case of no conflict, the following embodiments and features in the embodiments can be combined with each other.

FIG. 1 to FIG. 10 illustrate a heat exchanger in some embodiments of the present disclosure, which includes a main body 1, a first collecting component 2, a second collecting component and a distributor 3. The main body 1 is partially located between the first collecting component 2 and the second collecting component. One side of the main body 1 is connected to the first collecting component 2, and the other side of the main body 1 is connected to the second collecting component. The first collecting component 2 is substantially parallel to the second collecting component. The distributor 3 is connected to the first collecting component 2. The distributor 3 is located at least partially in a cavity of the first collecting component 2.

In some embodiments, the first collecting component 2 includes a first collecting pipe 21, and the second collecting component includes a second collecting pipe 4. In some embodiments, a length direction of the first collecting pipe 21 is parallel to a length direction of the second collecting pipe 4. In some embodiments, both the first collecting pipe 21 and the second collecting pipe 4 are cylindrical, and an axis of the first collecting pipe 21 is parallel or substantially parallel to an axis of the second collecting pipe 4.

FIG. 1 illustrates a heat exchanger in some embodiments. The main body 1 includes a plurality of heat exchange tubes 12, a plurality of fins 13 and side plates 11. The heat exchange tubes 12 are disposed along the length direction of the first collecting pipe 21. One side of the heat exchange tube 12 in a longitudinal direction is connected to the first collecting pipe 21, and the other side of the heat exchange tube 12 in the longitudinal direction is connected to the second collecting pipe 4. In some embodiments, the heat exchange tube 12 is connected to the first collecting pipe 21 and the second collecting pipe 4, respectively, by brazing. The first collecting pipe 21 has a first collecting cavity 210. The second collecting pipe 4 has a second collecting cavity 40. An inner cavity of the heat exchange tube 12 is in communication with the first collecting cavity 210 and the second collecting cavity 40, respectively.

The fins 13 are located between the first collecting pipe 21 and the second collecting pipe 4. The fins 13 are at least partially located between two adjacent heat exchange tubes 12. In some embodiments, the fins 13 are connected to the heat exchange tubes 12 by brazing. In the embodiment shown in FIG. 1, the fins 13 are only provided on one side of the heat exchanger close to the first collecting component 2. This does not mean that the fins 13 only exist in this position. The number and position of the fins 13 can be adjusted arbitrarily according to different requirements for the heat exchanger.

As shown in FIG. 1, the main body 1 includes two side plates 11. The two side plates 11 are located on two sides of the main body 1, respectively. That is, they are located on two sides of the first collecting pipe 21 in the length direction of the first header. The shapes and dimensions of the two side plates 11 may be the same or different. In some embodiments, the two side plates 11 are arranged symmetrically, and the two side plates 11 are parallel to each other. In some embodiments, the side plates 11 are connected to the heat exchange tubes 12 and/or the fins 13 by brazing. It can be understood that the main body 1 can also be provided with only one side plate 11 or no side plate 11.

The first collecting component 2 further includes a first end cover 22 and a second end cover 23. The first end cover 22 and the second end cover 23 are located on two sides of the first collecting pipe 21, respectively, in the length direction of the first collecting pipe 21, and are connected to two sides of the first collecting pipe 21, respectively, in the length direction of the first collecting pipe 21. Specifically, the first end cover 22 is matched with one side of the first collecting pipe 21 in the length direction of the first collecting pipe 21, and the second end cover 23 is matched with the other side of the first collecting pipe 21 in the length direction of the first collecting pipe 21.

The first collecting pipe 21 includes a first collecting end portion 211, a second collecting end portion 212 and a third circumferential wall 213. The first collecting end portion 211 and the second collecting end portion 212 are located on two sides of the first collecting pipe 21 in the length direction of the first collecting pipe 21. The first end cover 22 is connected to the first collecting end portion 211 to seal the first collecting end portion 211. The second end cover 23 is connected to the second collecting end portion 212 to seal the second collecting end portion 212. The first collecting pipe 21 further defines a first collecting cavity 210. The third circumferential wall 213 surrounds the first collecting cavity 210. Part or all of the first distributor 3 is located in the first collecting cavity 210. In some embodiments, the first collecting pipe 21 is a cylindrical pipe.

Figure 9:
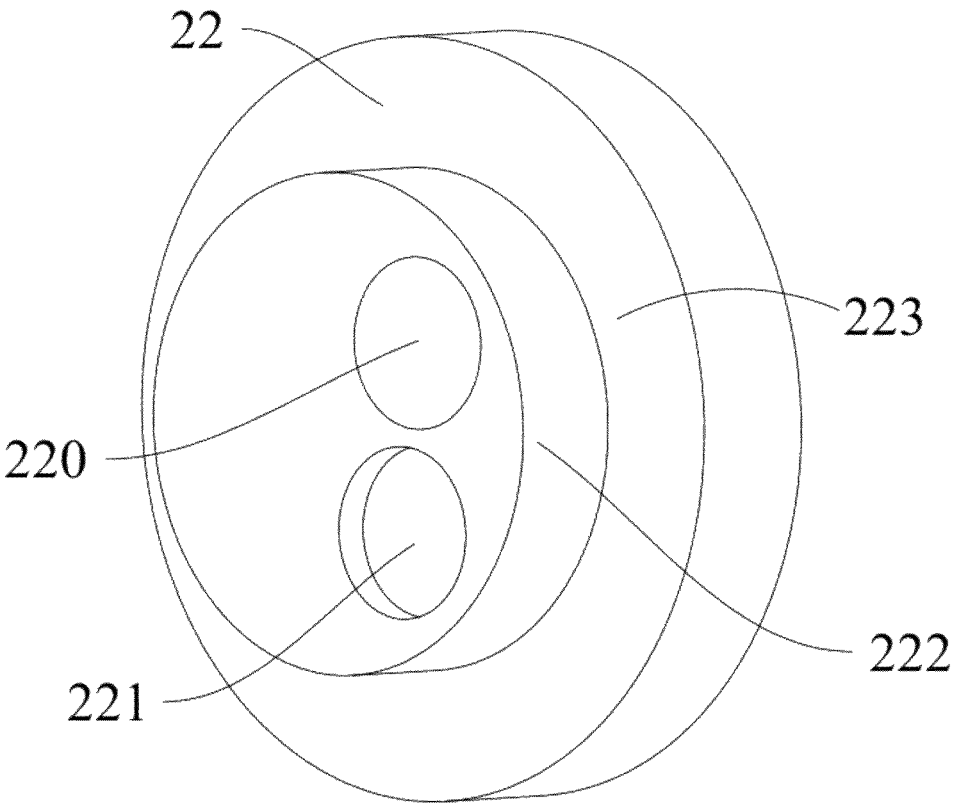
FIG. 9 is a schematic perspective structural view of a first end cover of the heat exchanger shown in FIG. 5.
Figure 10:
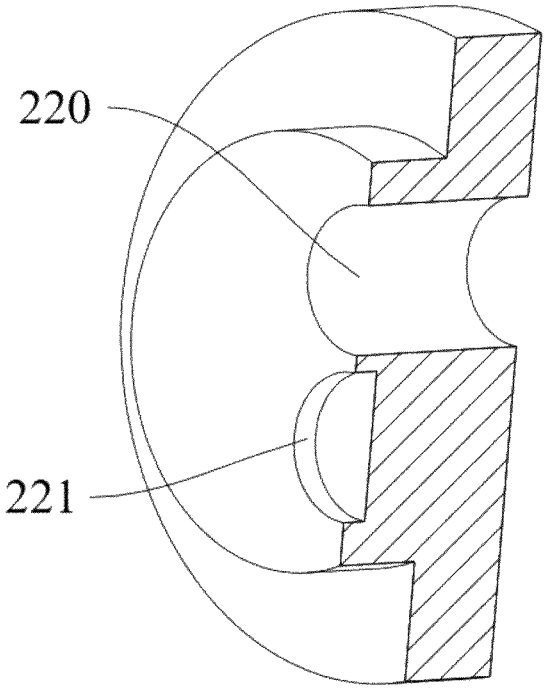
FIG. 10 is a schematic perspective cross-sectional view of the first end cover shown in FIG. 9.

Specifically, for example, as shown in FIG. 9 and FIG. 10, the first end cover 22 includes a protruding portion 222 and a body portion 223. The protruding portion 222 protrudes outwardly from one side of the body portion 223 along a thickness direction of the first end cover 22. The protruding portion 222 is located close to the first collecting cavity 210 relative to the body portion 223. The protruding portion 222 is at least partially exposed to the first collecting cavity 210. In some embodiments, the body portion 223 and the protruding portion 222 are cylindrical. A diameter of the protruding portion 222 is smaller than a diameter of the body portion 223. The protruding portion 222 mates with the first collecting end portion 211. In some embodiments, the diameter of the protruding portion 222 is slightly less than or equal to an inner diameter of the third circumferential wall 213. The diameter of the body portion 223 is larger than an inner diameter of the first collecting pipe 21.

In some embodiments, the first end cover 22 is connected to the first collecting end portion 211 by brazing. In some embodiments, the protruding portion 222 and the body portion 223 are hermetically connected to the third circumferential wall 213.

Figure 5:
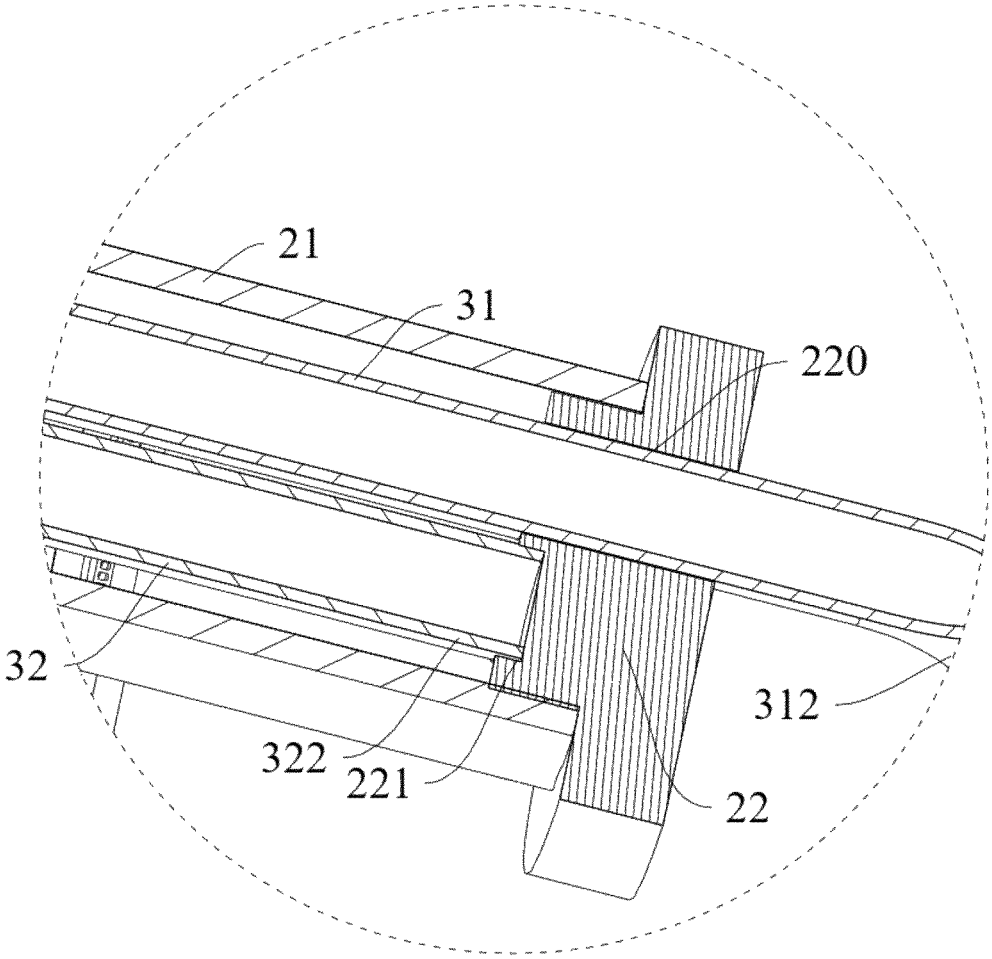
FIG. 5 is an enlarged structural schematic view of a circled portion B shown in FIG. 3.
Figure 6:
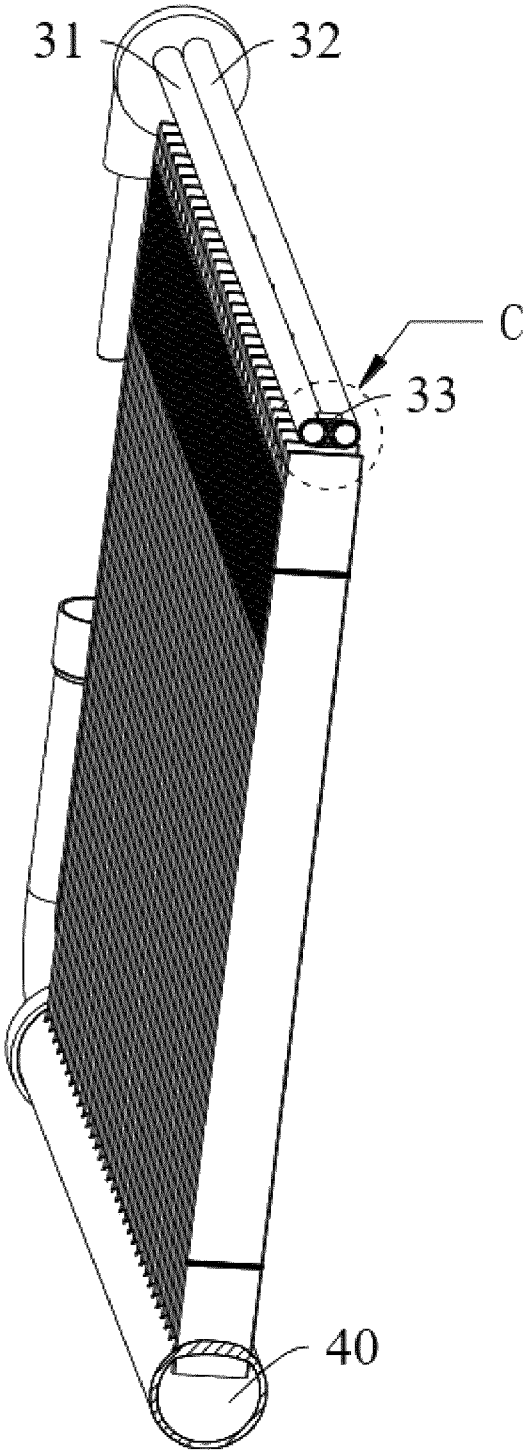
FIG. 6 is a partial perspective cross-sectional view of the heat exchanger in some embodiments of the present disclosure, in which a first collecting pipe is omitted.

In some embodiments, as shown in FIG. 9 and FIG. 10, the first end cover 22 further defines an end cover through hole 220 and an end cover groove 221. The end cover through hole 220 and the end cover groove 221 are spaced apart from each other. Specifically, the end cover through hole 220 is partially provided on the protruding portion 222. The end cover groove 221 is at least partially provided on the protruding portion 222. The end cover through hole 220 extends along the thickness direction of the first end cover 22 and extends through the first end cover 22. The end cover groove 221 is concave from a surface of the protruding portion 22 along the thickness direction of the first end cover 22. In some embodiments, the end cover through hole 220 has a circular cross-section, and the end cover groove 221 has a circular cross-section. The distributor 3 extends through the end cover through hole 220. An inner wall corresponding to the end cover through hole 220 is hermetically connected to the distributor 3. The distributor 3 is located at least partially in the end cover groove 221. The distributor 3 is connected to a corresponding groove wall of the end cover groove 221, for example, as shown in FIG. 5. In some embodiments, the distributor 3 abuts against a corresponding groove bottom of the end cover groove 221.

It can be understood that when the first end cover 22 is not provided with the protruding portion 222, the first end cover 22 is disk-shaped. The body portion 223 is attached to one side of the first collecting pipe 21 in the longitudinal direction of the first collecting pipe 21. The end cover through hole 220 is spaced apart from the end cover groove 221 in the body portion 223. The end cover through hole 220 extends along the thickness direction of the first end cover 22 and extends through the body portion 223. The end cover groove 221 is concave along the thickness direction of the first end cover 22.

One side of the second end cover 23 mates with an inner wall surface of the second collecting end portion 212, and the other side mates with an end surface of the second collecting end portion 212 for blocking the second collecting end portion 212. In some embodiments, the second end cover 23 is connected to the second collecting end portion 212 by brazing.

FIG. 2 to FIG. 5 illustrate the distributor 3 in some embodiments of the present disclosure, which includes a first distribution pipe 31, a second distribution pipe 32 and a connecting component 33. The first distribution pipe 31 and the second distribution pipe 32 are two independent pipes. The first distribution pipe 31 and the second distribution pipe 32 are disposed side by side and spaced apart from each other. The connecting component 33 is at least partially clamped between the first distribution pipe 31 and the second distribution pipe 32. The first distribution pipe 31 is at least partially located in the first collecting cavity 210. The entire second distribution pipe 32 is located in the first collecting cavity 210. In some embodiments, a length of the first distribution pipe 31 located in the first collecting cavity 210 is equal to or substantially equal to a length of the second distribution pipe 32, and the length of the second distribution pipe 32 is equal to or substantially equal to a length of the first collecting cavity 210. One side of the connecting component 33 is connected to the first distribution pipe 31, and the other side of the connecting component 33 is connected to the second distribution pipe 32.

In some embodiments, both the first distribution pipe 31 and the second distribution pipe 32 are cylindrical pipes, and the first distribution pipe 31 and the second distribution pipe 32 are parallel and spaced apart from each other. That is, an axis of the first distribution pipe 31 is parallel to an axis of the second distribution pipe 32. A plane defined by the axis of the first distribution pipe 31 and the axis of the second distribution pipe 32 is parallel to an end surface of the heat exchange tube 12 in the length direction of the heat exchange tube 12. In other embodiments, the first distribution pipe 31 is a round pipe, a square pipe, an elliptical pipe, or a pipe with other shapes. Taking a plane perpendicular to the length direction of the first distribution pipe 31 as a cross section and cutting the first distribution pipe 31 with this cross section, a corresponding inner wall of a first distribution chamber forms a circle, a square or an ellipse on the cross section. Similarly, the second distribution pipe 32 may be a round pipe, a square pipe, an elliptical pipe, or a pipe with other shapes.

In some embodiments, a flow area of the first distribution pipe 31 is 0.5 to 5 times that of the second distribution pipe 31. In some embodiments, the flow area of the first distribution pipe 31 is equal to the flow area of the second distribution pipe 32.

Figure 3:
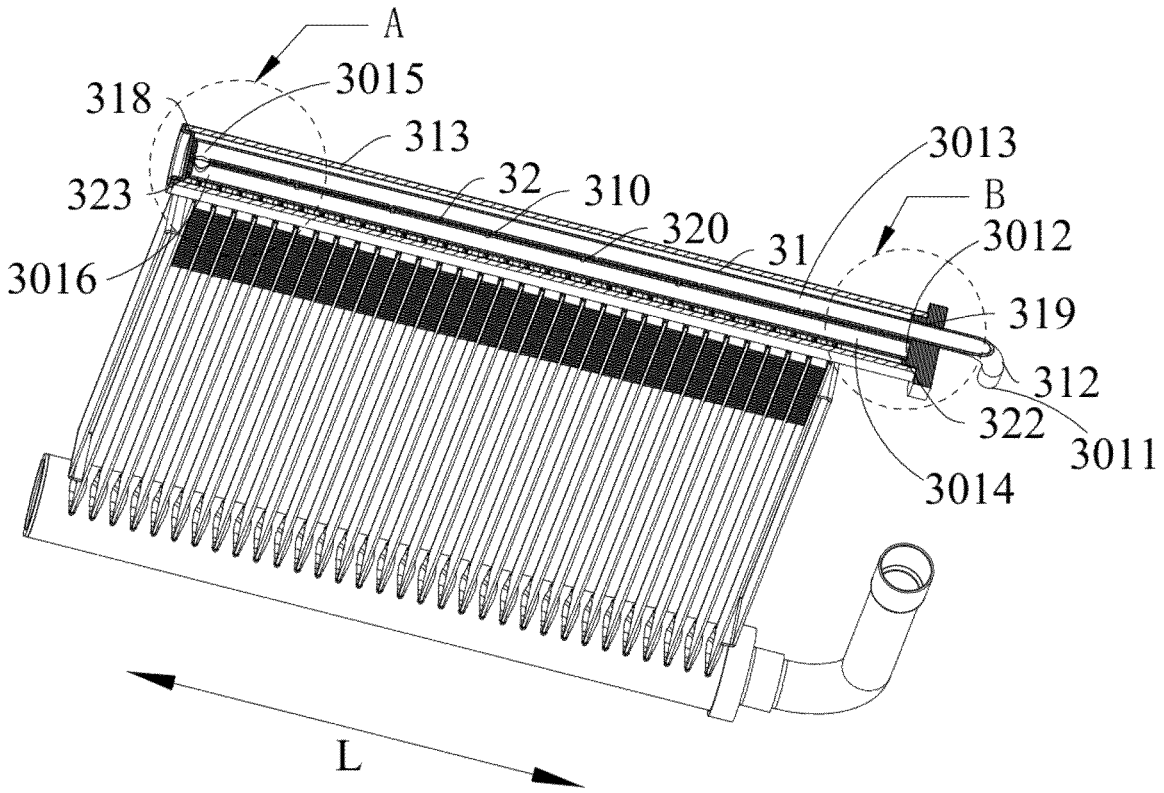
FIG. 3 is a schematic perspective cross-sectional view of a first collecting component of the heat exchanger shown in FIG. 1.
Figure 4:
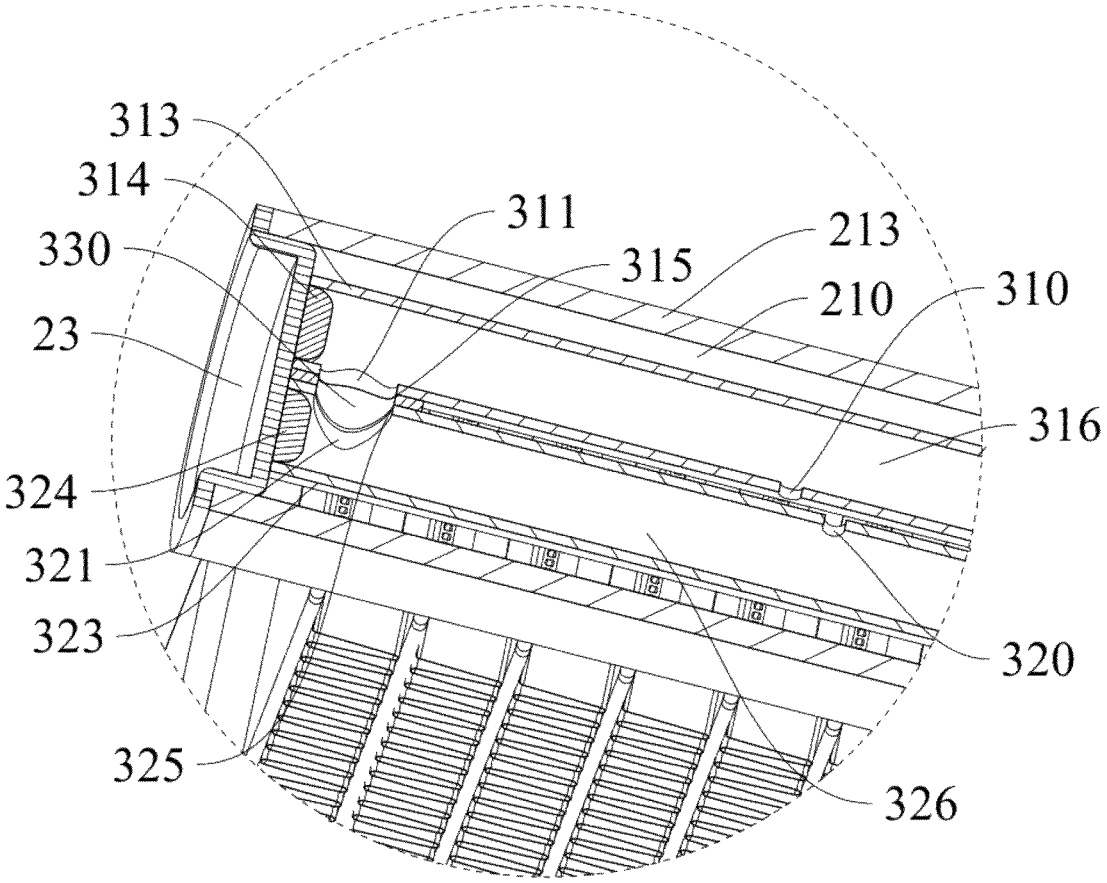
FIG. 4 is an enlarged structural schematic view of a circled portion A shown in FIG. 3.

FIG. 3 to FIG. 5 illustrate the first distribution pipe 31 in some embodiments of the present disclosure. The first distribution pipe 31 includes a first pipe portion 313 and a second pipe portion 312 which are connected. An inner chamber of the first pipe portion 313 communicates with an inner chamber of the second pipe portion 312. The first pipe portion 313 is located inside the first collecting pipe 21, and the second pipe portion 312 is located outside the first collecting pipe 21. The first pipe portion 313 is in a shape of a straight pipe. The second pipe portion 312 is in a shape of an elbow and is bent in a direction close to the second collecting pipe 4. The second pipe portion 312 is configured for connection with external components of the heat exchanger.

The first pipe portion 313 includes a first end portion 318 and a first connecting portion 319. The first end portion 318 and the first connecting portion 319 are located on different sides in a length direction of the first pipe portion 313, and the first connecting portion 319 is located between the first end portion 318 and the second pipe portion 312. The first connecting portion 319 extends through the end cover through hole 220. The first end portion 318 is close to a side of the first collecting pipe 21. In some embodiments, the first end portion 318 is connected to the second end cover 23, for example, as shown in FIG. 4. In some embodiments, the first end portion 318 abuts against the second end cover 23. In some embodiments, a hole diameter of the end cover through hole 220 is equal to, slightly smaller than, or slightly larger than an outer diameter of the first connecting portion 319. In some embodiments, the first distribution pipe 31 is a round pipe, a square pipe or an oval pipe. That is, an inner chamber of the first distribution pipe 31 is circular, square or elliptical.

Figure 7:
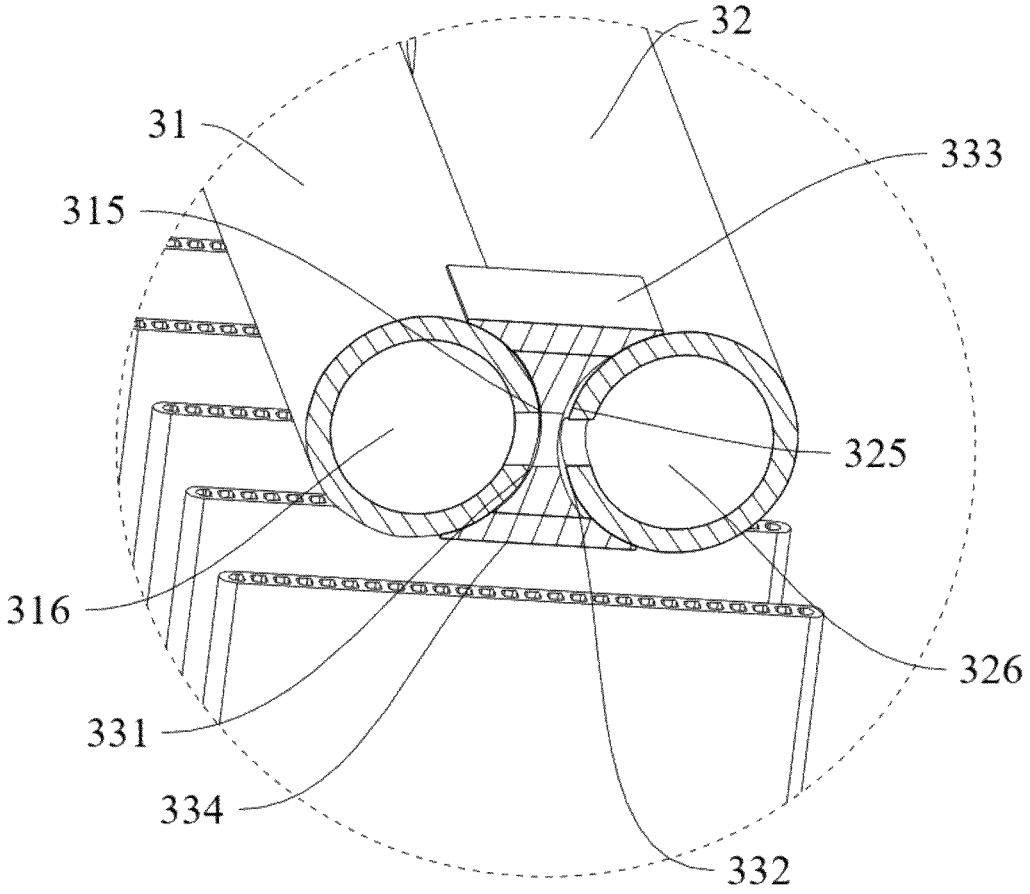
FIG. 7 is an enlarged structural schematic view of a circled portion C shown in FIG. 6.

The first distribution pipe 31 includes a first circumferential wall 317 and a first mating surface 315. The first mating surface 315 is located on an outer wall surface of the first circumferential wall 317, and the first mating surface 315 is a curved surface convex outwardly from an interior of the first distribution pipe 31, for example, as shown in FIG. 7. The first mating surface 315 is configured for mating with a third mating surface 331 of the connecting component 33.

The first distribution pipe 31 further defines a first distribution chamber 316, a first communication hole 311 and a plurality of first distribution holes 310. The first circumferential wall 317 surrounds the first distribution chamber 316. The plurality of first distribution holes 310 extend through the first circumferential wall 317, respectively, and are configured to communicate with the first distribution chamber 316 and the first collecting cavity 210. The first communication hole 311 extends through the first mating surface 315 and is configured to communicate with the first distribution chamber 316 and the second distribution chamber 326. When the heat exchanger is working, the fluid flows from the first distribution chamber 316 to the second distribution chamber 326 through the first communication hole 311, and at the same time, the fluid is distributed from the first distribution holes 310 to the first collecting cavity 210, that is, the fluid is ejected from the first distribution holes 310 and/or flow into the first collecting cavity 210.

Figure 2:
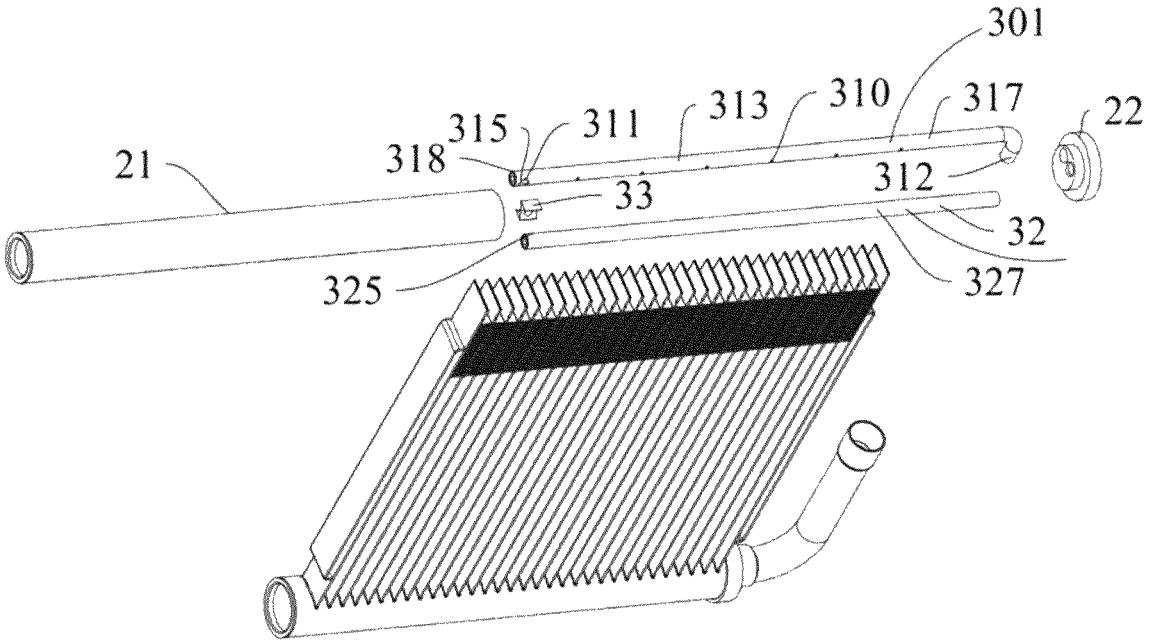
FIG. 2 is an exploded structural view of some components of the heat exchanger shown in FIG. 1.

In some embodiments, as shown in FIG. 2, the first distribution holes 310 are evenly disposed along the length direction of the first distribution pipe 31, and the sizes of the plurality of first distribution holes 310 are substantially equal. From the first connecting portion 319 to the first end portion 318, the amount of fluid distributed by the first distribution holes 310 to the first collecting cavity 210 increases sequentially. In some embodiments, the first distribution holes 310 face a circumferential wall of the second distribution pipe 32. In some embodiments, the first distribution hole 310 is a round hole. In some embodiments, a corresponding hole diameter of the first distribution hole 310 is 0.1 mm to 5 mm, such as 1 mm, 1.5 mm, 3 mm, 3.5 mm, 4 mm, or 4.5 mm. In some embodiments, the number of first distribution holes 310 is N1, the number of heat exchange tubes 12 is N2, where N1/N2 is 0.1 to 10. N1/N2 is equal to 1, 3, 5, 6, etc., for example.

Figure 11:
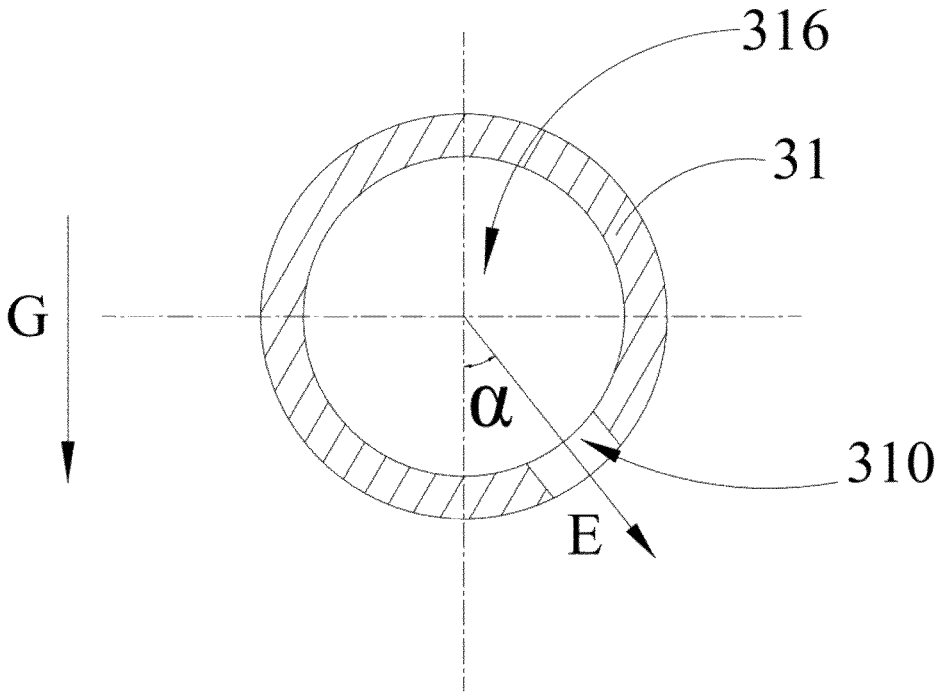
FIG. 11 is a schematic view of a first distribution hole provided by an embodiment of the present disclosure.

In some embodiments, for example, as shown in FIG. 11, an included angle $\alpha$ is formed between an extension direction E of the first distribution hole 310 and a direction of gravity G, where $-90 \leq \alpha \leq 90°$. For example, $\alpha$ is 45°. In some embodiments, the extension direction E of the first distribution hole 310 intersects the axis of the first distribution pipe 31. The axis of the first distribution pipe 31 is, for example, a center of an annular cross-section of the first distribution pipe 31 as shown in FIG. 11. In some embodiments, the direction of gravity G is in a same direction as the length direction of the heat exchange tube 12. In some embodiments, an angle between an extension direction of the second distribution hole 320 and a neutral direction is also greater than or equal to −90° and less than or equal to 90°. In this way, it is beneficial to the uniform distribution of refrigerant in the heat exchange tubes 12.

As shown in FIG. 3 and FIG. 4, the first end portion 318 includes a third end cover 314. The third end cover 314 is configured to block or seal the first end portion 318. The third end cover 314 is located at least partially in the first distribution chamber 316. The third end cover 314 is in a shape of a disc with protrusion. One side of the third end cover 314 abuts against the second end cover 23, and the other side of the third end cover 314 mates with the first end portion 318. In some embodiments, the third end cover 314 is hermetically connected to the first circumferential wall 317.

In some embodiments, the third end cover 314 is connected to the first end portion 318 by brazing. In some embodiments, the third end cover 314 can also be connected to the first end portion 318 and/or the second end cover 23 by gluing, welding, hot melting, etc. In some embodiments, first mating surface 315 is located at first end portion 318.

FIG. 3 to FIG. 5 illustrate the second distribution pipe 32 in some embodiments of the present disclosure. The second distribution pipe 32 is in a shape of a straight pipe and includes a second end portion 322, a third end portion 323 and a second circumferential wall 327. The second end portion 322 and the third end portion 323 are located on two sides of the second distribution pipe 32, respectively, in the length direction of the second distribution pipe 32. The second end portion 322 is close to the second pipe portion 312 and is close to or located at the first collecting end portion 211. The third end portion 323 is close to or located at the second collecting end portion 212. In some embodiments, the second distribution pipe 32 is cylindrical.

The second end portion 322 mates with the end cover groove 221. Specifically, the second end portion 322 abuts against a bottom wall surface of the end cover groove 221 to better seal the second end portion 322. The second end portion 322 is hermetically connected to the groove bottom of the end cover groove 221. In some embodiments, a circumferential size of the second end portion 322 is equal to or slightly smaller than a circumferential size of a circumferential groove wall of the end cover groove 221 to better achieve sealing of the second end portion 322. In some embodiments, the second end portion 322 is connected to the end cover groove 221 by brazing.

The third end portion 323 includes a fourth end cover 324 which is configured to block or seal the third end portion 323, for example as shown in FIG. 4. The fourth end cover 324 is in a shape of a disc with protrusion. One side of the fourth end cover 324 abuts against the second end cover 23, and the other side of the fourth end cover 324 mates with the third end portion 323. In some embodiments, the fourth end cover 324 is connected to the third end portion 323 by brazing. It can be understood that the fourth end cover 324 can also be of other shapes, as long as an opening of the third end portion 323 can be sealed. Of course, the fourth end cover 324 can also be connected to the third end portion 323 by gluing, welding, hot melting, or other methods.

As shown in FIG. 7, the second distribution pipe 32 further includes a second mating surface 325. The second mating surface 325 is a curved surface protruding from an interior of the second distribution pipe 32 for mating with the fourth mating surface 332 of the connecting component 33. The second mating surface 325 is located on an outer wall surface of the second circumferential wall 327 and provided on the third end portion 323.

The second distribution pipe 32 further defines a second distribution chamber 326, a second communication hole 321 and a plurality of second distribution holes 320. The second circumferential wall 327 surrounds the second distribution chamber 326. The plurality of second distribution holes 320 extend through the second circumferential wall 327, respectively, and are configured to communicate with the second distribution chamber 326 and the first collecting cavity 210. The second communication hole 321 extends through the second mating surface 325 and is configured to communicate with the second distribution chamber 326 and the first distribution chamber 316.

When the heat exchanger is working, the fluid flows from the first distribution chamber 316 to the second distribution chamber 326 through the second communication hole 321. The fluid is distributed from the second distribution holes 320 to the first collecting cavity 210, that is, the fluid is ejected from the second distribution holes 320 and/or flows into the first collecting cavity 210. In some embodiments, the second distribution holes 320 are evenly disposed along the length direction of the second distribution pipe 32, and the sizes of the plurality of second distribution holes 320 are substantially equal. From the second end portion 322 to the third end portion 323, the amount of fluid distributed by the first distribution holes 310 to the first collecting cavity 210 decreases sequentially. In some embodiments, the second distribution holes 320 face a circumferential wall of the first distribution pipe 31. The second distribution hole 320 is a round hole.

In some embodiments, a corresponding hole diameter of the second distribution hole 320 is 0.1 mm to 5 mm, such as 1 mm, 1.5 mm, 3 mm, 3.5 mm, 4 mm, or 4.5 mm. In some embodiments, the number of second distribution holes 320 is N1, the number of heat exchange tubes 12 is N2, where N1/N2 is 0.1 to 10. N1/N2 is equal to 1, 3, 5, 6, etc., for example.

It is understood that the sizes of the plurality of second distribution holes 320 may also be different. Correspondingly, the sizes of the plurality of first distribution holes 310 may also be different. Through reasonable configuration, the amount of fluid ejected from the first distribution holes 310 is larger or smaller, and the amount of fluid ejected from the second distribution holes 320 is smaller or larger. Therefore, the amount of fluid ejected from the first distribution holes 310 and the amount of fluid ejected from the second distribution holes 320 complement each other, thereby achieving uniform distribution of the fluid amount in the first collecting cavity 210.

In some embodiments, the number of first distribution holes 310 and the number of second distribution holes 320 are equal. The first distribution holes 310 and the second distribution holes 320 are staggered along the length direction of the first collecting pipe 21. The first distribution holes 310 and the second distribution holes 320 are staggered along the length direction of the first collecting pipe 21. The plurality of first distribution holes 310 are located in a first straight line. The plurality of second distribution holes 320 are located in a second straight line. A plane defined by the first straight line and the second straight line is parallel to an end surface of one end of the heat exchange tube 12 in the length direction of the heat exchange tube 12. When the heat exchanger is working, the fluid flowing out from the first distribution holes 310 and/or the second distribution holes 320 flows along a gap between the first distribution pipe 31 and the second distribution pipe 32, reducing the fluid disturbance in the first collecting cavity 210. In some embodiments, the first distribution holes 310 are comparable in size to the second distribution holes 320. In some embodiments, the first distribution holes 310 face the second distribution pipe 32. The first distribution holes 310 are located between the first distribution chamber 316 and the second distribution chamber 326. The second distribution holes 320 face the first distribution pipe 31. The second distribution holes 320 are located between the first distribution chamber 316 and the second distribution chamber 326.

FIG. 2, FIG. 4, FIG. 7 and FIG. 8 illustrate the connecting component 33 in some embodiments, which includes a third mating surface 331 and a fourth mating surface 332. The third mating surface 331 and the fourth mating surface 332 are disposed opposite to each other, and located on two sides of the connecting component 33. Both the third mating surface 331 and the fourth mating surface 332 are concave curved surfaces, that is, they are formed inwardly from a surface of the connecting component 33. The third mating surface 331 mates with the first mating surface 315. In some embodiments, the curvature of the third mating surface 331 is equal to the curvature of the first mating surface 315, so that the third mating surface 331 is in contact with the first mating surface 315. The curvature of the fourth mating surface 332 is equal to the curvature of the second mating surface 325, so that the fourth mating surface 332 is in contact with the second mating surface 325. In some embodiments, the third mating surface 331 is connected to the first mating surface 315 by brazing. The fourth mating surface 332 is connected to the second mating surface 325 by brazing. The third mating surface 331 is hermetically connected to the first mating surface 315; and the fourth mating surface 332 is hermetically connected to the second mating surface 325, as shown in FIG. 7, for example.

In some embodiments, the connecting component 33 has a groove 335 formed inwardly from a surface of the connecting component 33. The groove 335 includes a first groove 3351 and a second groove 3352. The third mating surface 331 is located on a periphery of the first groove 3351. The first mating surface 315 is at least partially located in the first groove 3351. The first mating surface 315 is hermetically connected to the third mating surface 331. The fourth mating surface 332 is located at a periphery of the second groove 3352. The second mating surface 325 is at least partially located in the second groove 3352. The second mating surface 325 is hermetically connected to the third mating surface 332.

The connecting component 33 includes a first surface 333 and a second surface 334 which are located on different sides of the connecting component 33. The first surface 333 is connected between the third mating surface 331 and the fourth mating surface 332. The second surface 334 is connected between the third mating surface 331 and the fourth mating surface 332. Both the first surface 333 and the second surface 334 are planar. The first surface 333 and the second plane 334 are parallel or substantially parallel. In some embodiments, a distance between first surface 331 and second surface 332 is equal to a diameter of first distribution pipe 31; and the distance between the first surface 331 and the second surface 332 is equal to a diameter of the second distribution pipe 32.

Figure 8:
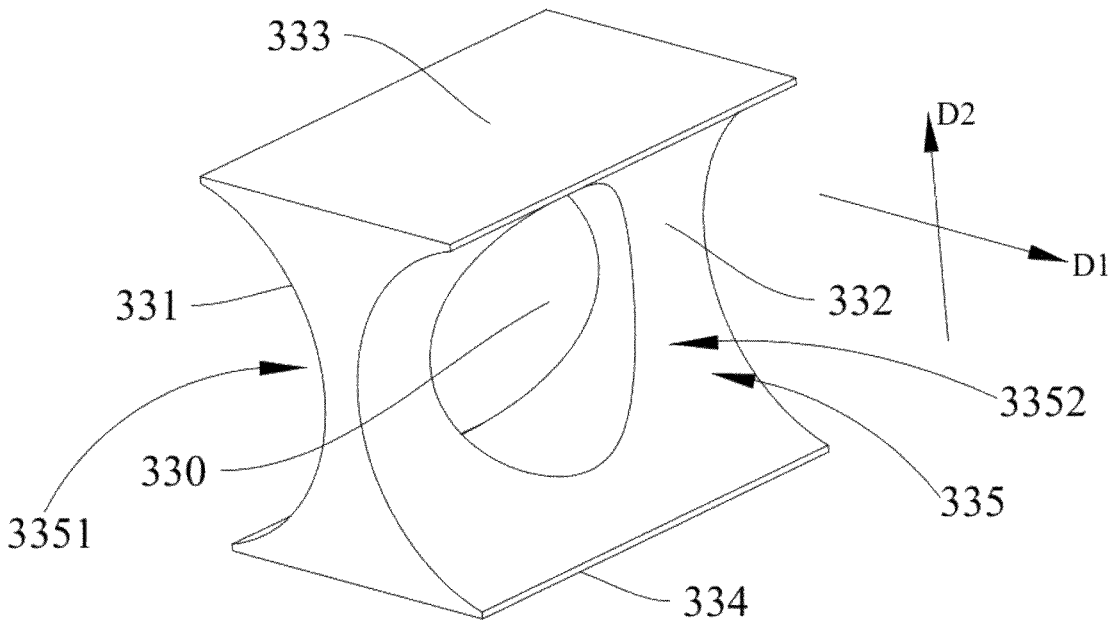
FIG. 8 is a schematic perspective structural view of a connecting component of the heat exchanger shown in FIG. 1.

In some embodiments, such as shown in FIG. 8, the connecting component 33 has a first direction D1 and a second direction D2. The first direction D1 is a direction in which the groove 335 is recessed inwardly from the surface of the connecting component 33. Along the second direction D2, the first surface 331 and the second surface 332 are located on different sides of the connecting component 33, respectively. Both the first direction D1 and the second direction D2 are in a same direction as a radial direction of the first distribution pipe 31. Both the first direction D1 and the second direction D2 are in a same radial direction of the second distribution pipe 32. The first direction D1 is perpendicular to the second direction D2.

As shown in FIG. 8, the connecting component 33 further defines a connection channel 330. The connection channel 330 extends through the third mating surface 331 and the fourth mating surface 332, and is configured to communicate with the first distribution chamber 316 and the second distribution chamber 326. One side of an extension direction of the connection channel 330 is in communication with the first communication hole 311, and the other side of the extension direction of the connection channel 330 is in communication with the second communication hole 321. The first communication hole 311 at least partially faces the connection channel 330. The second communication hole 321 at least partially faces the connection channel 330. When the heat exchanger is working, the fluid flows from the first distribution chamber 316 into the second distribution chamber 326 through the first communication hole 311, the connection channel 330 and the second communication hole 321 in sequence.

It can be understood that the size of the first communication hole 311 is much larger than the size of the first distribution hole 310. The first communication hole 311 is configured to allow the fluid to flow from the first distribution chamber 316 into the connection channel 330 and the second communication hole 321, and then to flow into the second distribution chamber 326. The first distribution holes 310 are configured to distribute the fluid from the first distribution chamber 316 to the second distribution chamber 326. It can be understood that the size of the second communication hole 321 is much larger than the size of the second distribution hole 320. The second communication hole 321 is configured to allow the fluid to flow from the first distribution chamber 316 into the second distribution chamber 326. The second distribution holes 320 are configured to distribute the fluid from the second distribution chamber 326 to the first collecting cavity 210.

When the heat exchanger is working, the fluid flows from the second pipe portion 312 of the first distribution pipe 31 into the first distribution chamber 316 and to the first end portion 318; the fluid flows into the second distribution chamber 326 through the first communication hole 311, the connection channel 330 and the second communication hole 321 in sequence, and flows to the second end portion 322; and the fluid path terminates at the second end portion 322, thereby forming a U-shaped fluid path. During the above fluid flow process, the fluid is sprayed into and/or flows into the first collecting cavity 210 from the first distribution holes 310, and is sprayed into and/or flows into the first collecting cavity 210 from the second distribution holes 320. From the second pipe portion 312 to the first end portion 318 of the first distribution pipe 31, the flow rate of the fluid distributed into the first collecting cavity 210 gradually increases. From the second end portion 322 to the third end portion 323 of the second distribution pipe 32, the flow rate of the fluid distributed to the first collecting cavity 210 gradually decreases. The flow rate ejected and/or outflowed from the first distribution holes 310 and the flow rate ejected and/or outflowed from the second distribution holes 320 compensate for each other, thereby enabling the fluid to be evenly distributed in the first collecting cavity 210 and evenly distributed so as to the heat exchange tubes 12 to improve the heat exchange effect of the heat exchanger.

In some embodiments, for example, as shown in FIG. 1 to FIG. 3, the heat exchanger includes a collecting component 2 and a distribution pipe 301. The collecting component 2 has a collecting cavity 210. The collecting component 2 has a first end 214 and a second end 215. The first end 214 and the second end 215 are located at two ends of the collecting component 2, respectively, along the length direction of the collecting component 2. The distribution pipe 301 extends through the first end 214, and the distribution pipe 301 is connected to the first end 214. The distribution pipe 301 has an open end 3011 and a closed end 3012. The closed end 3012 is located in the collecting cavity 210. The open end 3011 is located outside the collecting component 2. The distribution pipe 301 includes a first pipe body portion 3013 and a second pipe body portion 3014. The first pipe body portion 3013 is at least partially disposed side by side with the second pipe body portion 3014. The first pipe body portion 3013 includes a first connecting end 3015 and the open end 3011. The second pipe body portion 3014 includes a second connecting end 3016 and the closed end 3012. Along the length direction of the collecting component 2, the first connecting end 3015 and the second connecting end 3016 are both close to the second end 215 relative to the closed end 3012. The first connecting end 3015 is connected to the second connecting end 3016. The first pipe body portion 3013 has first distribution holes 310 and a first distribution chamber 316. The first distribution holes 310 communicate the first distribution chamber 316 with the collecting cavity 210. The second pipe body portion 3014 has second distribution holes 320 and a second distribution chamber 326. The second distribution holes 320 communicate the second distribution chamber 326 with the collecting cavity 210. The first connecting end 3015 has a first communication hole 311. The first communication hole 311 communicates with the first distribution chamber 316. The first communication hole 311 communicates with the second distribution chamber 326. Along the length direction of the first pipe body portion 3013, the first communication hole 311 is close to the second end 215 relative to the first distribution hole 310. Except for the first communication hole 311 and the first distribution holes 310, the first pipe body portion 3013 has no other holes capable of communicating the first distribution chamber 316 with the second distribution chamber 326. The second connecting end 3016 has a second communication hole 321. The second communication hole 321 communicates with the first distribution chamber 316. The second communication hole 321 communicates with the second distribution chamber 326. Along the length direction of the second pipe body portion 3014, the second communication hole 321 is close to the second end 215 relative to the second distribution holes 320. Except for the second communication hole 321 and the second distribution holes 320, the second pipe body portion 3014 has no other holes capable of communicating the first distribution chamber 316 with the second distribution chamber 326. The distribution pipe 301 has a path for one-way flow of fluid. The path includes the first distribution chamber 316, the first communication hole 311, the second communication hole 321 and the second distribution chamber 326.

In some embodiments, the distribution pipe 301 includes the first distribution pipe 31 and the second distribution pipe 32. The first distribution pipe 31 and the second distribution pipe 32 are pipes provided independently of each other. The first distribution pipe 31 includes a first pipe body portion 3013. The first connecting end 3015 is closed. The second distribution pipe 32 includes a second pipe body portion 3014. The second connecting end 3016 is closed. Both the first communication hole 311 and the first distribution holes 310 face the second distribution pipe 32. Both the second communication hole 321 and the second distribution holes 320 face the first distribution pipe 31. In some embodiments, a hole diameter of the first communication hole 311 is larger than a hole diameter of the first distribution hole 310. A hole diameter of the second communication hole 321 is larger than a hole diameter of the second distribution hole 320. The hole diameter of the first communication hole 311 is equal to the hole diameter of the second communication hole 321.

The above descriptions are only preferred embodiments of the present disclosure, and are not intended to limit the present disclosure in any form. Although the present disclosure has been disclosed above in terms of preferred embodiments, this is not intended to limit the present disclosure. Those of ordinary skill in the art can make slight changes or modifications to equivalent embodiments with equivalent changes using the technical content disclosed above without departing from the scope of the disclosed technical solution. However, any simple modifications, equivalent changes and modifications made to the above embodiments based on the technical essence of the present disclosure that do not deviate from the content of the technical solution of the present disclosure still fall within the scope of the technical solution of the present disclosure.

What is claimed is:

1. A heat exchanger, comprising:

a first collecting pipe, the first collecting pipe defining a first collecting cavity; and a distributor, the distributor being at least partially located in the first collecting cavity;

wherein the distributor comprises a first distribution pipe, a second distribution pipe and a connecting component, the first distribution pipe and the second distribution pipe are disposed side by side and spaced apart from each other, and the connecting component is located at least partially between the first distribution pipe and the second distribution pipe;

the first distribution pipe defines a plurality of first distribution holes, the second distribution pipe defines a plurality of second distribution holes, and the first distribution holes and the second distribution holes are in communication with the first collecting cavity, respectively;

the first distribution pipe has a first mating surface, the second distribution pipe has a second mating surface, the connecting component has a third mating surface and a fourth mating surface, the first mating surface is mated with the third mating surface, and the second mating surface is mated with the fourth mating surface;

the first distribution pipe defines a first distribution chamber, the second distribution pipe defines a second distribution chamber, the connecting component defines a connection channel, the connection channel is located between the first mating surface and the second mating surface, and the connection channel communicates with the first distribution chamber and the second distribution chamber;

wherein the first distribution pipe comprises a first pipe portion located in the first collecting pipe and a second pipe portion located outside the first collecting pipe;

the heat exchanger further comprises a first end cover and a second end cover, the first end cover and the second end cover are connected to different sides of the first collecting pipe, respectively, in a length direction of the first collecting pipe; the first end cover has an end cover through hole and an end cover groove, the end cover through hole extends through the first end cover along a thickness direction of the first end cover, and the end cover groove is concave along the thickness direction of the first end cover;

the first pipe portion comprises a first end portion and a first connecting portion, the first end portion and the first connecting portion are located on different sides of the first pipe portion, respectively, in a length direction of the first pipe portion; the first connecting portion is located between the first end portion and the second pipe portion, the first connecting portion is at least partially located within the end cover through hole, and the first end portion is disposed adjacent to or abutting against one side of the first collecting pipe in the length direction of the first collecting pipe;

the second distribution pipe comprises a second end portion and a third end portion, the second end portion and the third end portion are located on different sides of the second distribution pipe, respectively, in a length direction of the second distribution pipe; the second end portion is inserted into the end cover groove, and the third end portion is disposed adjacent to or abutting against the one side of the first collecting pipe in the length direction of the first collecting pipe;

the first mating surface is provided on the first end portion, and the second mating surface is provided on the third end portion.

2. The heat exchanger according to claim 1, wherein the first distribution pipe comprises a first circumferential wall which surrounds the first distribution chamber, and the second distribution pipe comprises a second circumferential wall which surrounds the second distribution chamber;

an outer wall surface of the first circumferential wall comprises the first mating surface, and an outer wall surface of the second circumferential wall comprises the second mating surface.

3. The heat exchanger according to claim 1, wherein the third mating surface is in contact with the first mating surface, the fourth mating surface is in contact with the second mating surface, the connecting component is retained between the first distribution pipe and the second distribution pipe, and the connection channel extends through the third mating surface and the fourth mating surface.

4. The heat exchanger according to claim 3, wherein the first mating surface, the second mating surface, the third mating surface and the fourth mating surface are all curved surfaces;

the connecting component is connected to the first distribution pipe and the second distribution pipe, respectively, by brazing.

5. The heat exchanger according to claim 2, wherein the first distribution pipe comprises a first communication hole which extends through the first mating surface, the second distribution pipe comprises a second communication hole which extends through the second mating surface, one end of the connection channel is in communication with the first communication hole, and another end is in communication with the second communication hole;

the first communication hole is at least partially directed to the connection channel, and the second communication hole is at least partially directed to the connection channel.

6. The heat exchanger according to claim 1, wherein the third mating surface and the fourth mating surface are both concave arc surfaces, and concave directions of the third mating surface and the fourth mating surface are opposite; the first mating surface and the second mating surface are both convex arc surfaces, and convex directions of the first mating surface and the second mating surface are opposite;

along a length direction of the first collecting pipe, a length of the connecting component is smaller than a length of the first distribution pipe, and the length of the connecting component is smaller than a length of the second distribution pipe.

7. The heat exchanger according to claim 6, wherein the connecting component comprises a first surface and a second surface which are located on different sides of the connecting component, the first surface is connected between the third mating surface and the fourth mating surface, the second surface is connected between the third mating surface and the fourth mating surface, both the first surface and the second surface are planar, and the first surface and the second plane are in parallel.

8. The heat exchanger according to claim 1, wherein the first distribution pipe comprises a first pipe portion located in the first collecting pipe and a second pipe portion located outside the first collecting pipe;

the heat exchanger comprises a second collecting pipe and a heat exchange tube, the second collecting pipe defines a second collecting cavity, the heat exchange tube connects the first collecting pipe and the second collecting pipe, the heat exchange tube communicates with the first collecting pipe and the second collecting pipe, and the second pipe portion is in a shape of an elbow and is bent in a direction adjacent to the second collecting pipe.

9. The heat exchanger according to claim 2, wherein the first collecting pipe defines a first collecting cavity;

the first distribution holes face the first circumferential wall, the second distribution holes face the second circumferential wall, the number of the first distribution holes and the number of the second distribution holes are equal, and the first distribution holes and the second distribution holes are evenly disposed along a length direction of the first collecting pipe, respectively;

the first distribution holes and the second distribution holes are staggered along the length direction of the first collecting pipe, the plurality of the first distribution holes are disposed in a first straight line, the plurality of the second distribution holes are disposed in a second straight line, and a plane defined by the first straight line and the second straight line is parallel to an end surface of one end of the heat exchange tube in a length direction of the heat exchange tube.

10. The heat exchanger according to claim 1, wherein the heat exchanger comprises a plurality of heat exchange tubes which are connected to the first collecting pipe, inner cavities of the heat exchange tubes are in communication with the first collecting cavity, and the plurality of heat exchange tubes are disposed along a length direction of the first collecting pipe;

a sum of the number of the first distribution holes and the number of the second distribution holes is N1, the number of the heat exchange tubes is N2, where N1/N2 is 0.1 to 10.

11. The heat exchanger according to claim 1, wherein a hole diameter of the first distribution hole is 0.1 mm to 5 mm, and a hole diameter of the second distribution hole is 0.1 mm to 5 mm;

a flow area of the first distribution pipe is 0.5 to 5 times a flow area of the second distribution pipe;

the first distribution pipe is a round pipe, a square pipe or an elliptical pipe; the second distribution pipe is a round pipe, a square pipe or an elliptical pipe;

an angle between an extension direction of the first distribution holes and a direction of gravity is $\alpha$, where $-90° \leq \alpha \leq 90°$.

12. A heat exchanger, comprising:

a collecting component, the collecting component defining a collecting cavity, the collecting component having a first end and a second end which are located at two ends of the collecting component, respectively, along a length direction of the collecting component; and a distribution pipe, the distribution pipe extending through the first end and is connected with the first end, the distribution pipe having an open end and a closed end, the closed end being located in the collecting component, the open end being located outside the collecting component;

wherein the distribution pipe comprises a first pipe body portion and a second pipe body portion, the first pipe body portion is at least partially disposed side by side with the second pipe body portion; the first pipe body portion comprises a first connecting end and the open end, the second pipe body portion comprises a second connecting end and the closed end, along the length direction of the collecting component, the first connecting end and the second connecting end are both disposed adjacent to the second end relative to the closed end, the first connecting end is connected to the second connecting end;

the first pipe body portion defines a first distribution hole and a first distribution chamber, the first distribution hole communicates with the first distribution chamber and the collecting cavity; the second pipe body portion defines a second distribution hole and a second distribution chamber, the second distribution hole communicates with the second distribution chamber and the collecting cavity;

the first connecting end defines a first communication hole which communicates with the first distribution chamber and the second distribution chamber, along a length direction of the first pipe body portion, the first communication hole is disposed adjacent to the second end relative to the first distribution hole; except for the first communication hole and the first distribution hole, the first pipe body portion has no other holes capable of communicating the first distribution chamber with the second distribution chamber;

the second connecting end defines a second communication hole which communicates with the first distribution chamber and the second distribution chamber, along a length direction of the second pipe body portion, the second communication hole is disposed adjacent to the second end relative to the second distribution hole; except for the second communication hole and the second distribution hole, the second pipe body portion has no other holes capable of communicating the first distribution chamber with the second distribution chamber;

the distribution pipe has a path for one-way flow of fluid, and the path comprises the first distribution chamber, the first communication hole, the second communication hole and the second distribution chamber;

wherein the distribution pipe comprises a first distribution pipe and a second distribution pipe, and the first distribution pipe and the second distribution pipe are pipes arranged independently of each other;

the first distribution pipe comprises the first pipe body portion, the first connecting end is closed, the second distribution pipe comprises the second pipe body portion, and the second connecting end is closed;

both the first communication hole and the first distribution hole extend toward the second distribution pipe, and both the second communication hole and the second distribution hole extend toward the first distribution pipe.

13. The heat exchanger according to claim 12, wherein a hole diameter of the first communication hole is larger than a hole diameter of the first distribution hole;

a hole diameter of the second communication hole is larger than a hole diameter of the second distribution hole;

the hole diameter of the first communication hole is equal to the hole diameter of the second communication hole.

14. The heat exchanger according to claim 12, wherein the heat exchanger comprises a connecting component which is at least partially located between the first connecting end and the second connecting end;

the first connecting end has a first mating surface through which the first communication hole extends, the second connecting end has a second mating surface through which the second communication hole extends, the connecting component comprises a third mating surface and a fourth mating surface, the first mating surface is mated with the third mating surface, and the second mating surface is mated with the third mating surface;

the connecting component defines a connection channel, the connection channel extends through the connecting component, the connection channel extends through the third mating surface and the fourth mating surface, and the connection channel communicates with the first communication hole and the second communication hole.

15. The heat exchanger according to claim 14, wherein the connecting component defines a groove formed inwardly from a surface of the connecting component;

the groove comprises a first groove and a second groove, the third mating surface is located on a periphery of the first groove, the first mating surface is at least partially located in the first groove, and the first mating surface is hermetically connected to the third mating surface;

the fourth mating surface is located on a periphery of the second groove, the second mating surface is at least partially located in the second groove, and the second mating surface is hermetically connected to the third mating surface.

16. The heat exchanger according to claim 12, wherein an angle between an extension direction of the first distribution hole and a direction of gravity is $\alpha$, where $-90° \leq \alpha \leq 90°$;

along the length direction of the collecting component, the first distribution hole and the second distribution hole are staggered.

17. The heat exchanger according to claim 12, wherein the heat exchanger comprises a plurality of heat exchange tubes which are connected to the collecting component, inner cavities of the heat exchange tubes are in communication with the collecting cavity, and the plurality of heat exchange tubes are disposed along the length direction of the collecting component;

a sum of the number of the first distribution holes and the number of the second distribution holes is N1, the number of the heat exchange tubes is N2, where N1/N2 is 0.1 to 10.

18. The heat exchanger according to claim 12, wherein a hole diameter of the first distribution hole is 0.1 mm to 5 mm, and a hole diameter of the second distribution hole is 0.1 mm to 5 mm;

a flow area of the first distribution pipe is 0.5 to 5 times a flow area of the second distribution pipe;

the first distribution pipe is a round pipe, a square pipe or an elliptical pipe; the second distribution pipe is a round pipe, a square pipe or an elliptical pipe.

* * * * *